US005850460A

United States Patent [19]

Tanaka et al.

[11] Patent Number: 5,850,460

[45] Date of Patent: Dec. 15, 1998

[54] BASS SPEAKER

[75] Inventors: Shoji Tanaka, Kobe; Kazuaki Tamura, Osaka; Satoshi Kageyama, Takatsuki, all of Japan

[73] Assignee: Matsushita Electric Industrial Co., Ltd., Osaka, Japan

[21] Appl. No.: 793,339

[22] PCT Filed: Aug. 31, 1995

[86] PCT No.: PCT/JP95/01728

§ 371 Date: Feb. 26, 1997

§ 102(e) Date: Feb. 26, 1997

[87] PCT Pub. No.: WO96/07291

PCT Pub. Date: Mar. 7, 1996

[30] Foreign Application Priority Data

Sep. 1, 1994 [JP] Japan ..... 6-208433

[51] Int. Cl.[6] ..... H04R 25/00

[52] U.S. Cl. ..... 381/186; 381/182; 381/335

[58] Field of Search ..... 381/24, 86, 87, 381/88, 89, 90, 158, 159, 188, 205, 182, 186, 300, 301, 302, 304, 305, 332, 335; 181/143, 144, 145, 147, 148, 155, 156

[56] References Cited

U.S. PATENT DOCUMENTS

| | | | |
|---|---|---|---|
| 4,146,744 | 3/1979 | Veranth | 181/156 |
| 4,783,820 | 11/1988 | Lyngdorf et al. | 381/89 |

FOREIGN PATENT DOCUMENTS

| | | | |
|---|---|---|---|
| 3825997 | 2/1990 | Germany | 381/159 |
| 4731638 | 4/1971 | Japan . | |
| 57-3500 | 1/1982 | Japan . | |
| 1140896 | 6/1989 | Japan . | |
| 3108999 | 5/1991 | Japan . | |
| 4-4700 | 1/1992 | Japan . | |
| 4117098 | 4/1992 | Japan . | |
| 9116798 | 10/1991 | WIPO | 381/159 |

OTHER PUBLICATIONS

Hiroyuki Yoshii, entitled "Extreme Low frequency Reproduction by a Passice Radiator and an Acoustic Transformer" appears at pp. 281 and 282 of the Oct. 1978 Report of the Meeting of the Acoustical Society of Japan.

An English Language Abstract of JP No. 4–4700.

An English Language Abstract of JP No. 1–140896.

An English Language Abstract of JP No. 57–3500.

An English Language Abstract of JP No. 3–108999.

An English Language Abstract of JP No. 4–117098.

English Language Translation of JP–47–31638.

*Primary Examiner*—Huyen Le

*Attorney, Agent, or Firm*—Greenblum & Bernstein, P.L.C.

[57] ABSTRACT

Passive radiators of the same effective vibration area and the same effective vibration mass disposed in mutual opposition, and driver units of the same effective vibration area and the same effective vibration mass disposed in mutual opposition, are mounted to a bandpass type enclosure. The vibration-reaction forces of the opposing passive radiators and opposing driver units on the enclosure are thereby mutually cancelled, and enclosure vibrations are thus greatly reduced. Powerful bass output can be achieved because the diameter of the passive radiators can be increased at will and the use of two passive radiators achieves an extremely large vibration area.

5 Claims, 10 Drawing Sheets

BASS SPEAKER

FIELD OF THE INVENTION

The present invention relates to a bass speaker designed for dynamic, high fidelity reproduction of low frequency sounds.

DESCRIPTION OF THE PRIOR ART

Widespread distribution of home entertainment systems for reproducing in the home and other small environments high quality audio sources and audio-visual sources has increased demand for compact speakers capable of reproducing the bass range sounds contained in those sources with power, dynamic presence, and high fidelity.

Dynamic reproduction of such bass sounds requires a large-diameter diaphragm and a sound pressure frequency characteristic that is flat to the lowest frequencies. With conventional sealed speaker enclosures and bass reflex enclosures, however, the Q of low band resonance frequencies increases as the size of the speaker opening increases relative to a constant internal speaker volume, thus producing a peak in the sound pressure-frequency characteristic. It has therefore been accepted that the bass speaker (woofer) opening cannot be very large relative to the enclosure size. High fidelity (quality) bass reproduction also means that sounds from enclosure vibration or resonance must be prevented, but it is difficult to suppress these sounds by simply increasing the thickness and weight of the speaker enclosure panels.

A bass speaker designed to obtain a flat sound pressure-frequency characteristic to low bass range sounds using a large-diameter vibrator with a small internal enclosure volume is described in "Extreme Low Frequency Sound Reproduction by a Passive Radiator and an Acoustic Transformer" (Yoshii Hiroyuki, Report of the Meeting of the Acoustical Society of Japan, October 1978, p. 281–282). The speaker described in this article is known today as a "bandpass" or "kelton" speakers. The structure of this conventional bass speaker is described below with reference to the simplified cross section thereof shown in FIG. 15.

Referring to FIG. 15, the inside of the bandpass-type speaker enclosure 103 is separated by an internal speaker divider 104 into a back cavity 105 and a front cavity 106. The driver unit 101 is mounted on the internal speaker divider 104 and a passive radiator 102 is mounted on the front enclosure panel 103*a* such that bass sounds are projected from the passive radiator 102. Note that the driver unit 101 and passive radiator 102 create an acoustic transducer in the front cavity 106.

The operation of this bass speaker is described next with reference to the electroacoustic equivalent circuit shown in FIG. 16 and FIG. 17 and the frequency characteristic graph shown in FIG. 18.

Referring to FIG. 16, drive force Fd is the drive force applied to the vibration system by the voice coil of the driver unit's magnetic circuit, the effective vibration mass Md is the effective vibration mass of the driver unit's vibration system, compliance Cd is the compliance of the driver unit support system (edges and dampers), and resistance Rd is the sum of the mechanical resistance of the driver unit vibration system and the electromagnetic braking resistance resulting from the counter-electromotive force of the magnetic circuit. Also indicated in FIG. 16 and FIG. 17 are the air compliance CB of the back cavity 105, the mechanical resistance RB of the air in the back cavity 105, the air compliance CF of the front cavity 106, the mechanical resistance RF of the air in the front cavity 106, the effective vibration mass Mp of the passive radiator vibration system, the mechanical resistance Rp of the passive radiator vibration system, the compliance Cp of the passive radiator support system (edges and dampers), the driver unit vibration system speed Vd, and the passive radiator vibration system speed Vp.

Other values referenced in FIG. 16 and FIG. 17 include the effective vibration area Sd of the driver unit and the effective vibration area Sp of the passive radiator, resulting in an acoustic transducer with a winding ratio of Sd:Sp. If the parameters of the passive radiator are converted from the driver unit side, an electroacoustic equivalent circuit as shown in FIG. 17 is obtained. More specifically, the effective vibration mass Mp is increased $(Sd/Sp)^2$ times, and the compliance Cp and mechanical resistance Rp are increased $(Sp/Sd)^2$ times. In this electroacoustic equivalent circuit Vp' is the passive radiator vibration speed, provided that the effective vibration area is assumed to be equivalent to driver unit area.

When the frequency is extremely low the impedance of back cavity air compliance CB increases, thereby reducing the speed Vd and resulting in attenuation of speed Vp or Vp'. When the frequency rises, the impedance of front cavity air compliance CF drops. The speed Vd is thus bypassed by the air compliance CF and speed Vp or Vp' attenuates. The attenuation curve is approximately 12 dB/oct at both low and high frequency ranges. In other words, this speaker provides a bandpass characteristic suitable for a bass speaker. In addition, the resonance action between the effective vibration mass Mp, effective vibration mass Md, air compliance CB, and air compliance CF within the bandpass frequency, i.e., the reproducible frequency band, also enable this speaker design to reproduce the bass range with significantly greater efficiency than can sealed-enclosure speakers. For example, resonance between primarily the effective vibration mass Mp and front cavity air compliance CF at frequencies near the lower limit of the reproducible frequency band produce a passive radiator speed Vp' several times greater than the driver unit vibration system speed Vd.

The bass reproduction efficiency of bass reflex enclosure speakers is as good as that of bandpass speakers, but at frequency levels below the cutoff frequency (below the antiresonant frequency of bass reflex speakers), the sounds emitted from the speaker unit and sounds emitted from the port are opposite-phase, and sound pressure attenuation below the cutoff frequency is therefore unacceptably great. With such bandpass speakers, however, the back of the driver unit is sealed. Sounds behind the driver unit therefore do not interfere with passive radiator sounds, and sound pressure attenuation below the cutoff frequency is therefore gradual, resembling sound pressure attenuation in sealed enclosure speakers. This gradual attenuation is more effective for the reproduction of bass range sounds.

By designing the speaker to optimize the parameters (Md, Mp, CB, CF, and Rd) having the greatest effect on speaker characteristics, a flat bandpass frequency characteristic as shown in FIG. 18 can be achieved. The bandpass width is usually 1 to 2.5 octaves. As shown in FIG. 18, this speaker has two resonance frequencies f1 and f2 and antiresonant frequency fr where resonance frequencies f1 and f2 are the bandpass characteristic cutoff frequency. In other words, the band from f1 to f2 is the reproducible frequency band according to general filter theory. The bandpass characteristics of sealed, bass reflex, and kelton speakers are shown in FIG. 20.

An important feature of this speaker is that even if the effective vibration area Sp is increased N times, a similarly flat frequency characteristic can be achieved by increasing the effective vibration mass Mp $N^2$ times. In other words, because the passive radiator can be sized at will, dynamic bass sounds can be obtained from a large-diameter diaphragm in an enclosure with a small internal volume.

Speakers using a speaker balancer as described in Japanese patent laid-open number (kokai) H4-4700 have been designed as speakers capable of sufficiently reducing the sounds of enclosure vibrations and resonance. The construction of this speaker is described below with reference to FIG. 19, a simplified cross sectional diagram of the speaker.

As shown in FIG. 19, a speaker unit 111 is mounted to the sealed enclosure 113, and the magnetic circuit 117*a* of the balancer 117 is mounted to the back of the speaker unit magnetic circuit 111*a* with a bonding board 118 disposed therebetween. Note that the magnetic circuit 117*a* of the balancer is identical to the magnetic circuit 111*a* of the speaker unit. The balancer 117 also comprises a weight 117*b* of the same mass as the vibration system 111*b* of the speaker unit 111. The balancer 117 thus generates inertial force equal to the inertial force (reactive force) generated by the speaker unit 111 but in the opposite direction.

This speaker operates as follows.

The inertial force generated by the balancer 117 has the same magnitude as the inertial force generated by the speaker unit 111 but an opposite vector, thereby causing the two inertial forces to cancel each other out. As a result, the inertial force of the speaker unit 111 does not travel to the sealed enclosure 113, enclosure vibrations are therefore fundamentally reduced.

However, because the diameter of the passive radiator is significantly greater (usually 1.3 to 2 times greater) than the diameter of the driver unit in this conventional bass speaker, the effective vibration mass of the passive radiator is also several to twenty times the effective vibration mass of the normal driver unit. As a result, the vibration-reaction force of the passive radiator vibration system on the enclosure via the air inside the front cavity increases significantly. This significantly increases the enclosure vibrations, and the enclosure emits a variety of noises, such as a loose shaking sound, resonance, and echoes.

On the other hand, conventional speakers designed to reduce enclosure vibrations have a sealed enclosure with the speaker unit opening limited in size, making it impossible to reproduce dynamic bass range sounds. In addition, half of the electrical input signal is consumed by the speaker balancer, resulting in a 6 dB drop in the output sound pressure level when compared with normal speakers, and extremely poor acoustic conversion efficiency.

While the speaker system described in Japanese patent laid-open notification (kokai) H1-140896 (1989-140896) has been proposed as a speaker that sufficiently reduces enclosure vibration and resonance noise, the disclosed speakers a sealed enclosure speakers without a passive radiator and therefore have the same problems described above.

SUMMARY OF THE INVENTION

The object of the present invention is therefore to resolve the above problem and provide a bass speaker for reproducing dynamic bass range sounds using a large-diameter diaphragm that is not limited in size by the internal volume of the enclosure while minimizing enclosure vibrations and not reducing the acoustic conversion efficiency.

A further object of the invention is provide a bass speaker whereby enclosure vibrations are minimized at all reproducible frequencies.

A further object of the invention is provide a bass speaker whereby no sound distortion is produced in the reproducible frequency band no matter how the speaker is positioned or what the listening conditions are.

To achieve the first object above, a bass speaker according to the present invention comprises an enclosure, first and second passive radiators mounted on an exterior wall of the enclosure in positions whereby the passive radiator axes are substantially parallel or coaxial, first and second supports disposed inside the enclosure, and first and second driver units mounted to the first and second supports such that the driver unit axes are coaxial or substantially parallel to the axes of the first and second passive radiators. More specifically, the present invention provides a bass speaker in which the first and second driver units and the first and second passive radiators are disposed to a bandpass type speaker enclosure, the phase of first driver unit and first passive radiator drive is matched to the phase of second driver unit and second passive radiator drive, the effective vibration area and the effective vibration mass of the first and second driver units are equal, and the effective vibration area and the effective vibration mass of the first and second passive radiators are equal.

To achieve the second object above a bass speaker according to the present invention designs the first resonant frequency of the enclosure wall connecting the speaker opening panels of the enclosure to be greater than the maximum cutoff frequency of the reproducible frequency band.

To achieve the third object above a bass speaker according to the present invention, the average distance around the enclosure from the acoustic center of the passive radiator at the front to the acoustic center of the other passive radiator is less than ½ the wavelength of the maximum cutoff frequency of the reproducible frequency band.

Because a flat sound pressure frequency characteristic can be achieved even when the size of the passive radiator is great, and because the total effective vibration area is made even greater by using plural passive radiators, extremely powerful, dynamic bass sounds can be reproduced. Furthermore, because the vibration reaction forces of the vibration system of each passive radiator acting on the enclosure are mutually cancelling, enclosure vibrations are reduced. There is also no electrical input signal loss and no drop in acoustic conversion (speaker) efficiency.

Enclosure vibrations are also reduced at all reproducible frequencies because the vibration reaction forces of the vibration system of each passive radiator and each driver unit acting on the enclosure are mutually cancelled to the maximum cutoff frequency of the reproducible frequency band.

With the bass speaker achieving the third object above cancellation of sounds emitted from the plural passive radiators is prevented in the reproducible frequency band irrespective of the speaker orientation and listening conditions, and sound output is therefore not disturbed.

BRIEF DESCRIPTION OF THE DRAWINGS

The present invention will become more fully understood from the detailed description given below and the accompanying diagrams wherein.

DESCRIPTION OF PREFERRED EMBODIMENTS

The preferred embodiments of the present invention are described below with reference to the accompanying figures.

Embodiment 1

Figure 1:
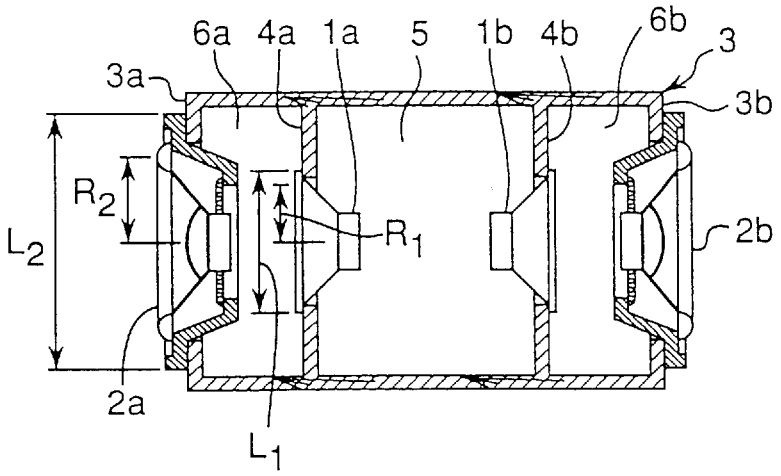
FIG. 1 is a simplified cross section of a bass speaker according to the first embodiment of the present invention.

FIG. 1 is a simplified cross section of a bass speaker according to the first embodiment of the present invention. The speaker of the invention comprises as shown in FIG. 1 a first driver unit 1*a* and a second driver unit 1*b* each with a diameter L1 of 22 cm, an effective vibration radius R1 of 85 mm, and an effective vibration mass of 18 g. As a result, both driver units have the same effective vibration area and vibration mass. The minimum resonant frequency of these driver units is 30 Hz, the dc resistance of the voice coil is 12 Ω, and the force factor BL of the magnetic circuit is 15.8 Wb/m. Both first and second driver units 11*a* and 11*b* are driven same-phase, and are electrically connected same-phase in parallel.

Both the first and second passive radiators 2*a* and 2*b* have a diameter L2 of 27 cm, an effective vibration radius R2 of 105 mm, an effective vibration mass of 160 g, and a minimum resonant frequency of 20 Hz. As a result both passive radiators also have the same effective vibration area and vibration mass.

The external dimensions of the first and second speaker unit opening panels 3*a* and 3*b*, respectively, of the bandpass type enclosure 3 are 39 cm×31 cm, and the distance between the outside surfaces of speaker unit opening panels 3*a* and 3*b* is 76 cm. The enclosure is made from 15 mm thick particle board. The first passive radiator 2*a* and the second passive radiator 2*b* are installed at mutually opposing positions in the first and second speaker unit opening panels 3*a* and 3*b*, respectively, with each passive radiator facing outside the enclosure.

The first and second driver units 1*a* and 1*b* are installed at mutually opposing positions in the first and second internal dividers 4*a* and 4*b* with the driver units placed back to back. The back cavity 5 formed between the first and second internal dividers 4*a* and 4*b* has an internal volume of approximately 60 liters. Both driver units 1*a* and 1*b* use this back cavity so that each driver unit has an equivalent back cavity volume of approximately 30 liters. The first and second front cavities 6*a* and 6*b* each have an internal volume of approximately 5 liters.

Figure 2:
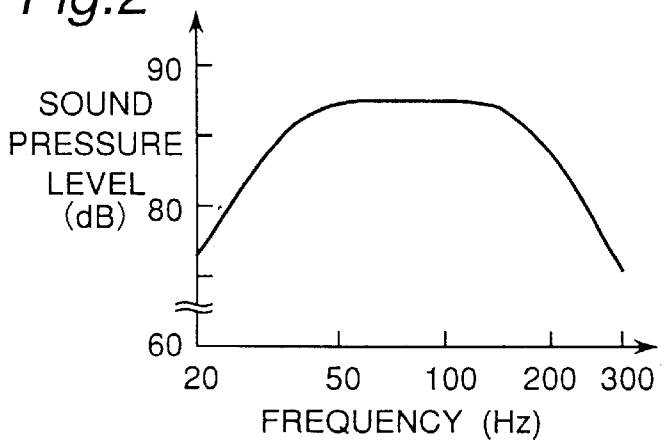
FIG. 2 is a graph of the sound pressure-frequency response characteristic of a bass speaker according to the first embodiment of the present invention.

The operation of the bass speaker thus comprised according to the present embodiment is described below with reference to FIG. 2 and FIG. 3. Both the first and second driver units 1*a* and 1*b* and the first and second passive radiators 2*a* and 2*b* operate in the same phase and with the same frequency response. The operation and characteristics of the bass speaker of the invention during bass range reproduction are therefore identical to the operation and characteristics of the conventional bass speaker described above. As shown in FIG. 2, the minimum cutoff frequency f1 (the resonant frequency of impedance) in the present embodiment is 32 Hz, the maximum cutoff frequency f2 (the resonant frequency of impedance) is 180 Hz, and a flat sound pressure frequency response is obtained across the reproducible frequency band from 32 Hz–180 Hz at −3 dB.

By using two passive radiators with a large diameter L2 of 27 cm, the total effective vibration area is equivalent to an extremely large 38 cm diameter radiator, thereby achieving bass output that is significantly greater than would normally be expected from an enclosure of the same size.

Because the mutually opposing first and second driver units 1*a* and 1*b* and first and second passive radiators 2*a* and 2*b* operate with the same frequency response and at the same acoustical phase, i.e., the mutually opposing diaphragms move in opposite directions, the vibration-reaction force of the first passive radiator 2*a* on the bandpass type enclosure 3 and the vibration-reaction force of the second passive radiator 2*b* on the bandpass type enclosure 3 have the same magnitude but opposite vectors. In addition, the vibration-reaction forces of the first driver unit 1*a* on the bandpass type enclosure 3 and the second driver unit 1*b* on the bandpass type enclosure 3 also have the same magnitude but opposite vectors.

This means that the vibration-reaction forces exerted by the first and second passive radiators 2*a* and 2*b* on the bandpass type enclosure 3 are mutually cancelling, the vibration-reaction forces exerted by the first and second driver units 1*a* and 1*b* are also mutually cancelling, and enclosure vibrations are thereby significantly reduced.

Figure 3:
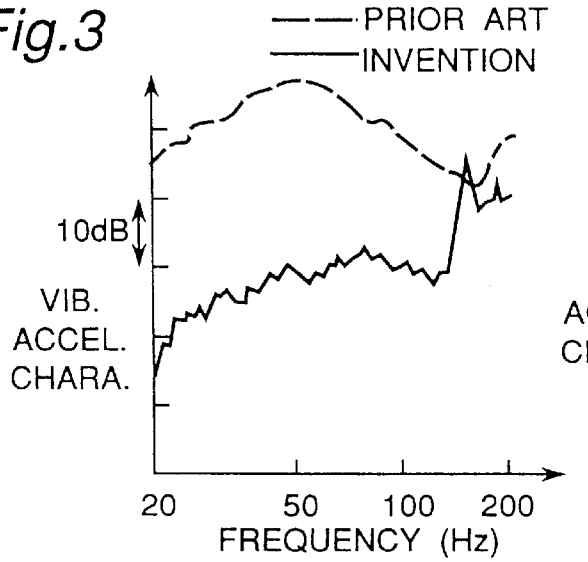
FIG. 3 is a graph of the vibration acceleration characteristic of the enclosure of a bass speaker according to the first embodiment of the present invention.
Figure 21:
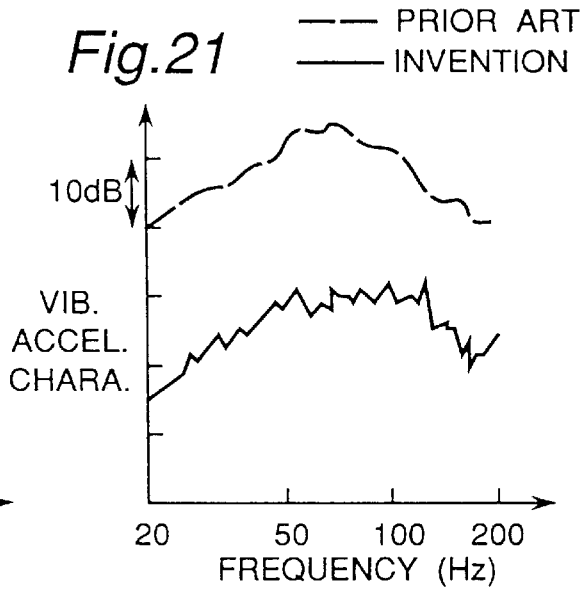
FIG. 21 is a graph of the vibration acceleration characteristic of the enclosure of a bass speaker according to the sixth embodiment of the present invention.

The graph shown in FIG. 3 was produced by placing a vibration pickup in front of each speaker unit opening in the enclosure of the bass speaker according to the present embodiment to measure the vibration acceleration. The dotted line was obtained by measuring the vibration acceleration from a conventional bandpass type speaker enclosure, i.e., a speaker enclosure having only one driver unit and matching passive radiator. Note that the conventional bandpass speaker enclosure was also made from 15 mm thick particle board. From FIG. 3 we therefore know that the bass speaker of the invention reduces enclosure vibrations approximately 20 dB on average across the output band when compared with a conventional bass speaker, and by approximately 30 dB at low frequencies. In addition, there is no loss of the electrical input signal with the present embodiment, and there is therefore also no drop in speaker's acoustic conversion efficiency.

Using plural large-diameter passive radiators, the present embodiment achieves an extremely large total effective vibration area, thereby enabling the reproduction of very powerful bass sounds. Enclosure vibrations are also significantly reduced, however, because the vibration-reaction forces of the vibration systems of the passive radiators and driver units acting on the enclosure cancel each other out. There is also no drop in speaker's acoustic conversion efficiency. In other words, regardless of how great the effective vibration mass of the passive radiator, the resulting vibration-reaction forces are extinguished and enclosure vibrations can be suppressed to a very low level. As a result, the diameter of the passive radiator is effectively not limited by the vibration mass of the passive radiator. It is also possible to achieve a bass range output with significantly greater power and dynamic presence than can be obtained from bass reflex type speakers and sealed speakers wherein the size of the speaker unit opening is limited.

It should be noted that while the first and second driver units 1*a* and 1*b* and first and second passive radiators 2*a* and 2*b* are coaxially arranged in the above embodiment, the invention shall not be so limited and the same effects can be obtained with other arrangements. For example, the first driver unit 1*a* and first passive radiator 2*a* can be placed on a second axis and the second driver unit 1*b* and second passive radiator 2*b* placed on a second axis where said first and second axes are parallel but not coaxial.

It is also possible to place each of the first and second driver units 1*a* and 1*b* and first and second passive radiators 2*a* and 2*b* on four discrete but parallel axes.

Furthermore, while the speaker unit opening panels in which the passive radiators are mounted and the internal divider in which the driver units are mounted are all parallel in the above embodiment, the same effects can be achieved by placing these panels and dividers at any desired angle to the others. This type of arrangement is described below as the second embodiment of the invention with reference to FIG. 4.

It should be further noted that while the present embodiment has been described using a typical bandpass type enclosure with front and back cavities, it will be obvious that the invention can also be achieved in other variations of the typical bandpass type enclosure. Some of these variations include disposing the port in a side wall to which no driver unit is installed, or disposing the port in a divider placed between the passive radiator and driver unit within the front cavity as in a double bandpass type speaker enclosure.

The effects of the present embodiment can also be obtained by assembling two speakers each having one driver unit and one passive radiator in a single enclosure, and then connecting these speakers back to back into a single enclosure. A divider separating the back cavity into two equal-volume chambers can also be alternatively provided.

It should also be noted that while the mutually opposing passive radiators and driver units in the above embodiment have been described as having identical specifications, and specifically the same effective vibration area and effective vibration mass, the above-noted effects of the invention can be obtained even if said specifications differ slightly.

It should also be noted that while the mutually opposing passive radiators and driver units in the above embodiment are mounted on parallel planes, the same effects can be obtained even if the mounting planes are not perfectly parallel. For example, the same effects can be obtained even if the passive radiator mounting surfaces are not perfectly parallel.

It will also be obvious that while only one driver unit and passive radiator each is mounted to one enclosure panel in the above embodiment, plural driver units and passive radiators may be mounted. It is also possible for each passive radiator and driver unit combination to use, for example, one passive radiator and two driver units, or vice versa, insofar as the total effective vibration area and the total effective vibration mass are identically balanced as described above.

In addition, the above embodiment has been described using a typical dynamic driver unit, i.e., a moving coil, but other driver unit designs, including electromagnetic and moving magnet, can obviously be alternatively used.

The second embodiment of a bass speaker according to the present invention is described next below with reference to FIG. 4.

Figure 4:
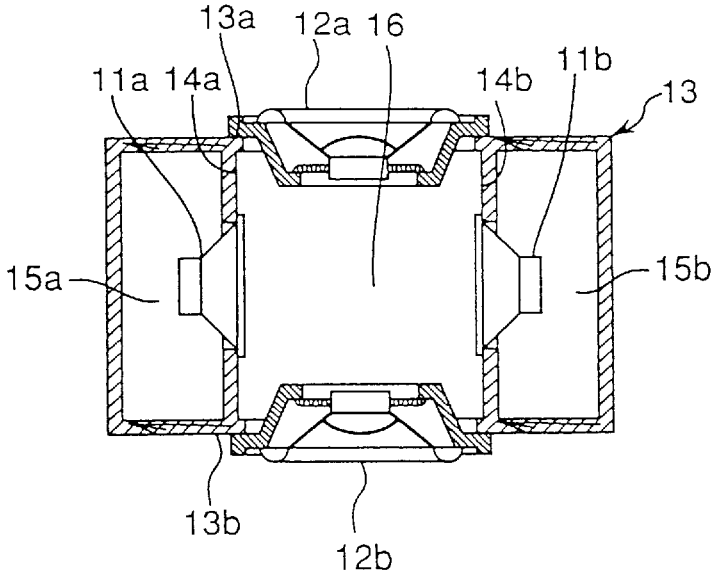
FIG. 4 is a simplified cross section of a bass speaker according to the second embodiment of the present invention.

The bass speaker of the second embodiment comprises as shown in FIG. 4 a first driver unit 11*a* and a second driver unit 11*b* each with a diameter of 22 cm, an effective vibration radius of 85 mm, and an effective vibration mass of 35 g. As a result, both driver units have the same effective vibration area and vibration mass. The minimum resonant frequency of these driver units is 25 Hz, the dc resistance of the voice coil is 12 Ω, and the force factor BL of the magnetic circuit is 14 Wb/m. Both first and second driver units 11*a* and 11*b* are driven same-phase, and are electrically connected same-phase in parallel.

Both the first and second passive radiators 12*a* and 12*b* have a diameter of 33 cm, an effective vibration radius of 130 mm, an effective vibration mass of 200 g, and a minimum resonant frequency of 15 Hz. As a result both passive radiators also have the same effective vibration area and vibration mass.

The external dimensions of the first and second speaker unit opening panels 13*a* and 13*b*, respectively, of the bandpass type enclosure 13 are 76 cm×39 cm, and the distance between the outside surfaces of speaker unit opening panels 13*a* and 13*b* is 31 cm. The enclosure is made from 15 mm thick particle board. The internal volume is the same as in the first embodiment above.

The first passive radiator 12*a* and the second passive radiator 12*b* are installed at mutually opposing positions in the first and second speaker unit opening panels 13*a* and 13*b*, respectively, with each passive radiator facing from the outside to the inside of the enclosure.

The first and second driver units 11*a* and 11*b* are installed at mutually opposing positions in the first and second internal dividers 14*a* and 14*b* with the driver units facing each other. Thus, unlike in the first embodiment above, the common axis of passive radiators 12*a* and 12*b* intersects the common axis of driver units 11*a* and 11*b* at 90°. Both the first back cavity 15*a* and the second back cavity 15*b* have the same internal volume of approximately 20 liters. The front cavity 16 has an internal volume of approximately 30 liters. Both passive radiators 12*a* and 12*b* use this front cavity so that each passive radiator has an equivalent front cavity volume of approximately 15 liters.

The operation of the bass speaker thus comprised according to the second embodiment is the same as that of the first embodiment. As a result, both the first and second driver units 11*a* and 11*b* and the first and second passive radiators 12*a* and 12*b* operate in the same phase and with the same frequency response. The operation and characteristics of the bass speaker of the invention during bass range reproduction are therefore identical to the operation and characteristics of the conventional bass speaker described above. The minimum cutoff frequency f1 in the present embodiment is 37 Hz, the maximum cutoff frequency f2 is 95 Hz, and a flat sound pressure frequency response is obtained across the reproducible frequency band from 37 Hz–95 Hz at −3 dB.

By installing the passive radiators in the enclosure panels with the greatest area, it is possible to install passive radiators that are even larger than those used in the first embodiment. Furthermore, while the actual diameter is 33 cm, the total effective vibration area is equivalent to an extremely large 46 cm diameter radiator. As a result, an even more powerful bass range can be reproduced.

Because the mutually opposing first and second driver units 11*a* and 11*b* and first and second passive radiators 12*a* and 12*b* operate with the same frequency response and at the same acoustical phase, i.e., the mutually opposing diaphragms move in opposite directions, the vibration-reaction force of the first passive radiator 12*a* on the bandpass type enclosure 13 and the vibration-reaction force of the second passive radiator 12*b* on the bandpass type enclosure 13 have the same magnitude but opposite vectors. In addition, the vibration-reaction forces of the first driver unit 11*a* on the bandpass type enclosure 13 and the second driver unit 11*b* on the bandpass type enclosure 13 also have the same magnitude but opposite vectors.

This means that the vibration-reaction forces exerted by the first and second passive radiators 12*a* and 12*b* on the bandpass type enclosure 13 are mutually cancelling, the vibration-reaction forces exerted by the first and second driver units 11*a* and 11*b* are also mutually cancelling, and enclosure vibrations are thereby significantly reduced. As a result, enclosure vibrations are reduced approximately 25 dB on average across the output band when compared with a conventional bass speaker design.

The bass speaker according to the second embodiment described above therefore achieves the same effects as the first embodiment. In addition, however, an even more powerful bass range can be reproduced because the passive radiators are installed to the enclosure panels with the greatest area, thereby enabling larger diameter passive radiators to be installed. This design also enables the speaker to be used with a smaller side of the enclosure facing down, thereby reducing the floor space required for speaker placement in the listening room.

It will also be obvious that the relationships between the mounting surfaces and positions, the numbers of driver units and passive radiators, the usable enclosure types, and other design parameters can also be varied in this embodiment as in the first embodiment above.

The third embodiment of a bass speaker according to the present invention is described next below with reference to FIG. 5.

Figure 5:
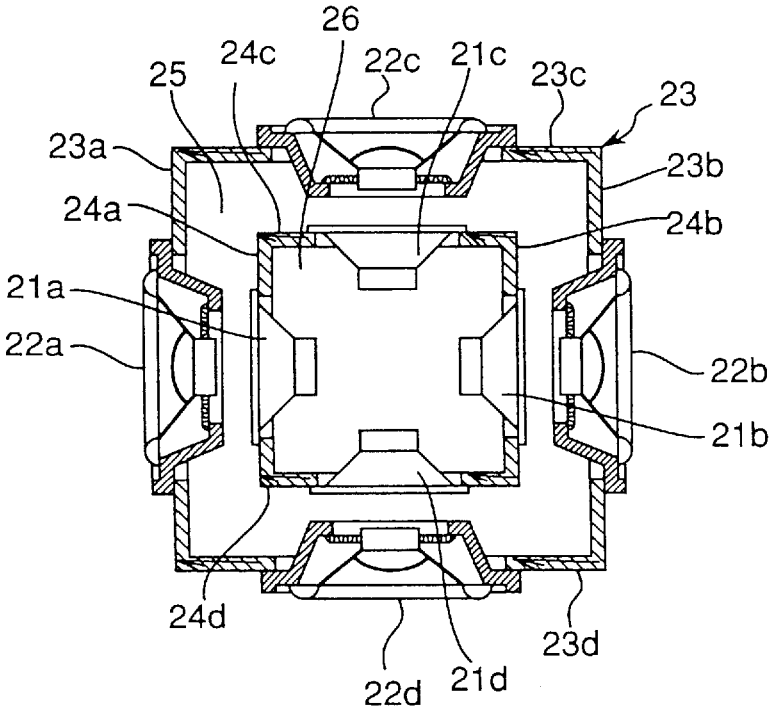
FIG. 5 is a simplified cross section of a plan view of a bass speaker according to the third embodiment of the present invention.

The bass speaker of the third embodiment comprises as shown in FIG. 5 a first driver unit 21*a* and a second driver unit 21*b* each with a diameter of 18 cm, an effective vibration radius of 69 mm, and an effective vibration mass of 12 g. As a result, both first and second driver units have the same effective vibration area and vibration mass.

The third and fourth driver units 21*c* and 21*d* each have a diameter of 14 cm, an effective vibration radius of 52 mm, and an effective vibration mass of 7 g. As a result, the third and fourth driver units have the same effective vibration area and vibration mass.

All four driver units 21*a*, 21*b*, 21*c*, and 21*d* are driven same-phase.

Both the first and second passive radiators 22*a* and 22*b* have a diameter of 30 cm, an effective vibration radius of 125 mm, an effective vibration mass of 550 g. As a result both first and second passive radiators also have the same effective vibration area and vibration mass.

The third and fourth passive radiators 22*c* and 22*d* each have a diameter of 25 cm, an effective vibration radius of 106 mm, an effective vibration mass of 150 g. As a result the third and fourth passive radiators also have the same effective vibration area and vibration mass.

The bandpass type enclosure 23 of this embodiment has a top panel with external dimensions of 54 cm×54 cm, an enclosure height of 33 cm, and approximately the same internal volume as the speaker according to the first embodiment. The enclosure is made from 15 mm thick particle board, and comprises first, second, third, and fourth speaker unit opening panels 23*a*, 23*b*, 23*c*, and 23*d* respectively.

The first passive radiator 22*a* and the second passive radiator 22*b* are installed at mutually opposing positions in the first and second speaker unit opening panels 23*a* and 23*b*, respectively, with each passive radiator facing to the outside of the enclosure. The third and fourth passive radiators 22*c* and 22*d* are likewise installed at mutually opposing positions in the third and fourth speaker unit opening panels 23*c* and 23*d*, respectively, with each passive radiator facing to the outside of the enclosure.

The speaker of this embodiment further comprises first, second, third, and fourth internal dividers 24*a*, 24*b*, 24*c*, and 24*d*. The first and second driver units 21*a* and 21*b* are installed at mutually opposing positions in the first and second internal dividers 24*a* and 24*b* with the driver units placed back to back, and the third and fourth driver units 21*c* and 21*d* are installed at mutually opposing positions in the first and second internal dividers 24*c* and 24*d*, also with the driver units placed back to back.

The bass speaker of the present embodiment thus contains a passive radiator and driver unit mounted at every surface of the enclosure other than the enclosure top and bottom with the effective vibration area and the effective vibration mass of the opposing driver units being the same, and the effective vibration area and the effective vibration mass of the opposing passive radiators being the same.

The back cavity 25 has an internal volume of approximately 50 liters. The equivalent internal volume occupied by each of the first and second driver units 21*a* and 21*b* is approximately 19 liters, and the equivalent internal volume occupied by each of the third and fourth driver units 21*c* and 21*d* is approximately 5.9 liters.

The front cavity 26 has an internal volume of approximately 20 liters. The first and second passive radiators 22*a* and 22*b* therefore occupy an equivalent internal volume of approximately 6.6 liters each, and the third and fourth passive radiators 22*c* and 22*d* each occupy an equivalent internal volume of approximately 3.4 liters.

Figure 12:
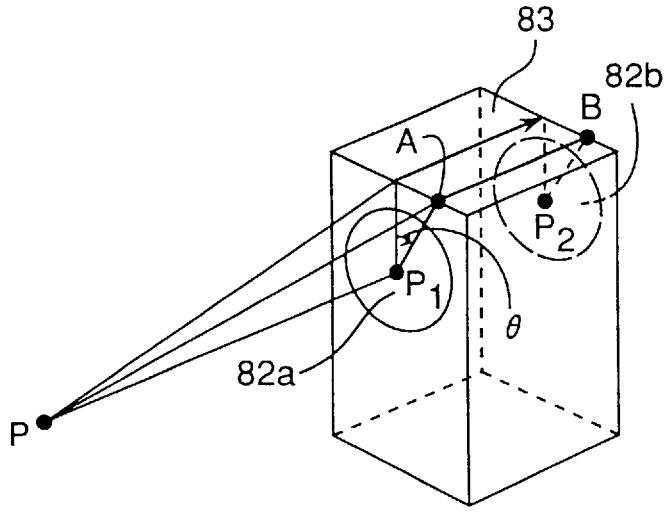
FIG. 12 is used to describe the method of calculating the average distance in the present invention.
Figure 13:
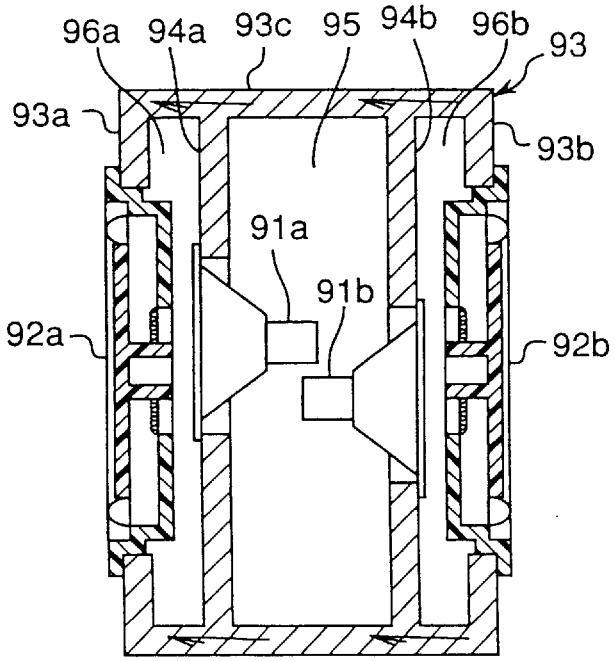
FIG. 13 is a simplified cross section of a bass speaker according to the sixth embodiment of the present invention.
Figure 14:
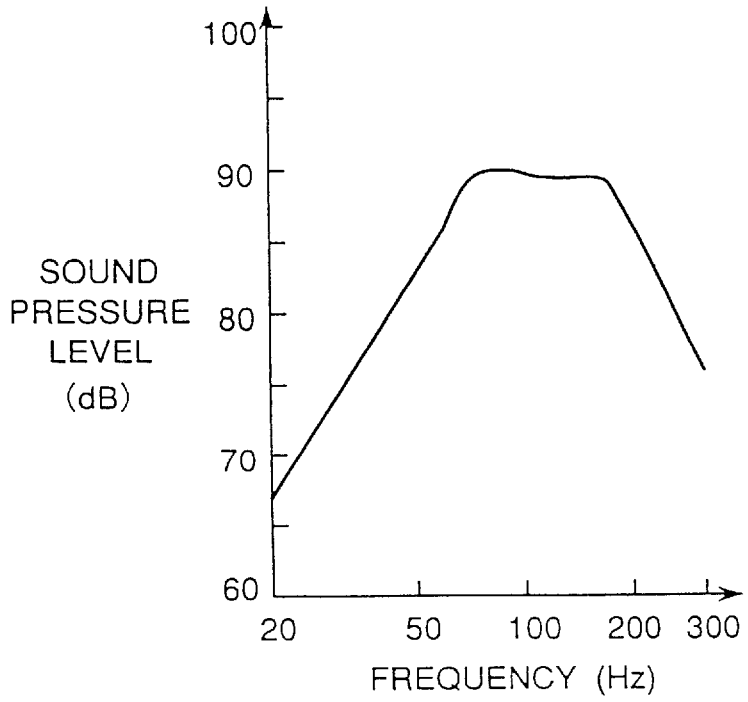
FIG. 14 is a graph of the sound pressure-frequency response characteristic of a bass speaker according to the sixth embodiment of the present invention.
Figure 15:
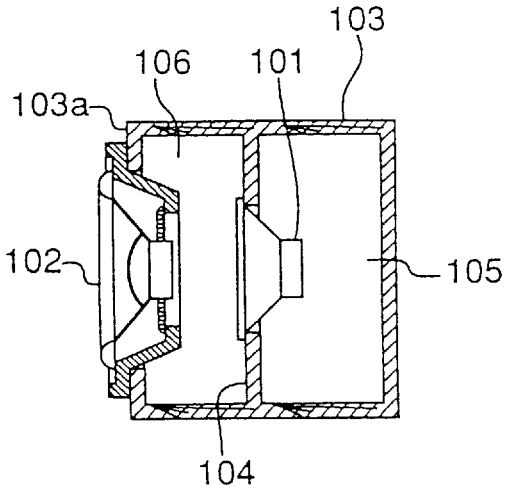
Fig. 15 Prior Art
FIG. 15 is a simplified cross section of a conventional bass speaker.
Figure 16:
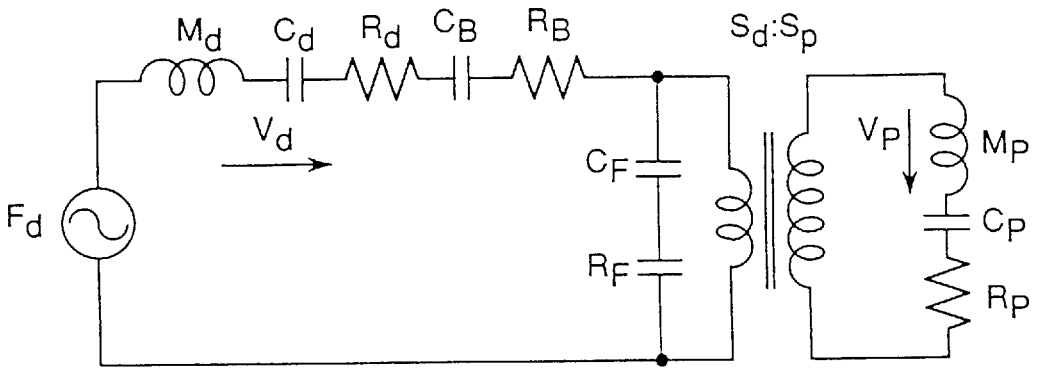
Prior Art Fig. 16
FIG. 16 is a circuit diagram of the electroacoustic equivalent network of a conventional bass speaker.
Figure 17:
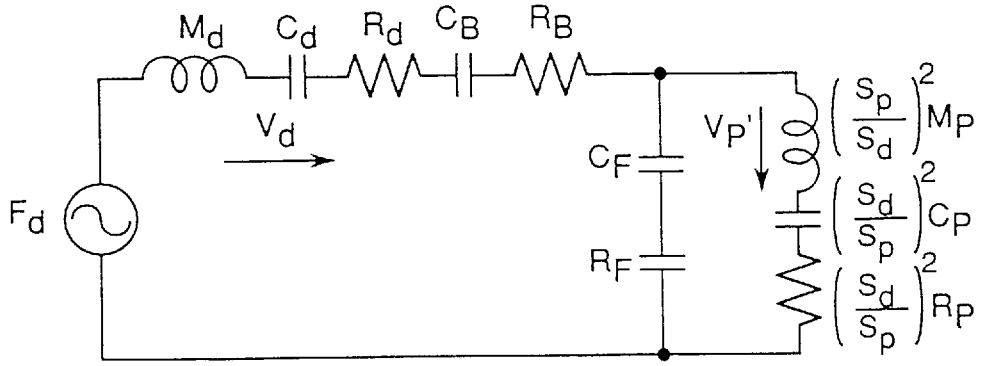
Prior Art Fig. 17
FIG. 17 is a circuit diagram of the electroacoustic equivalent network of a conventional bass speaker.
Figure 18:
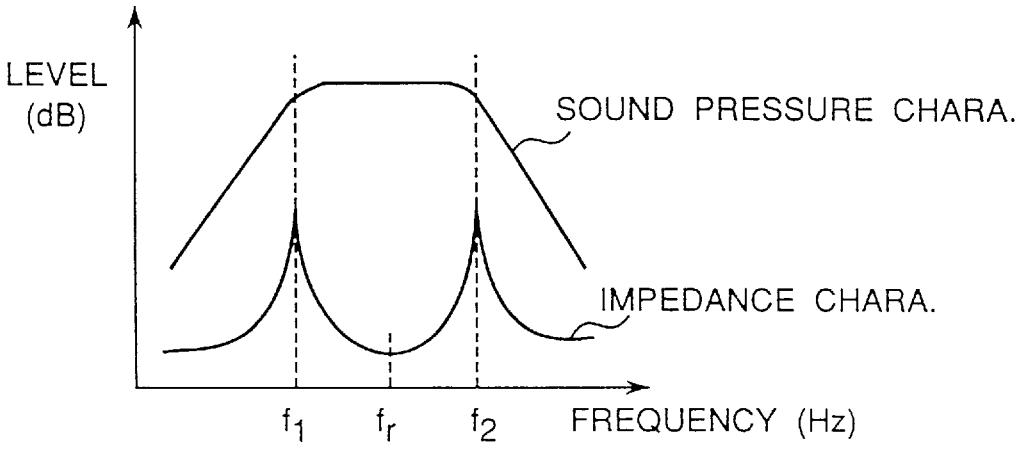
Prior Art Fig.18
FIG. 18 is a graph of the sound pressure and impedance frequency characteristics of a conventional bass speaker.
Figure 19:
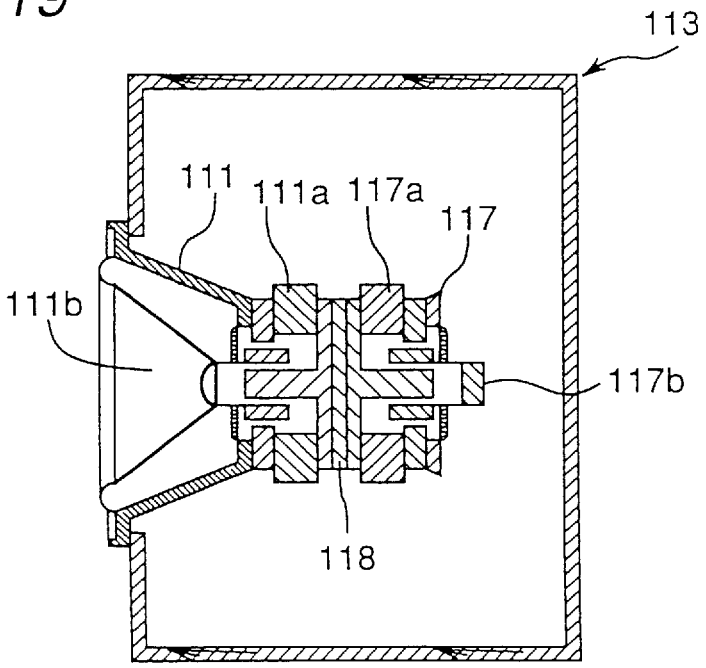
Fig.19 Prior Art
FIG. 19 is a simplified cross section of a conventional speaker in which enclosure vibrations are reduced.
Figure 20:
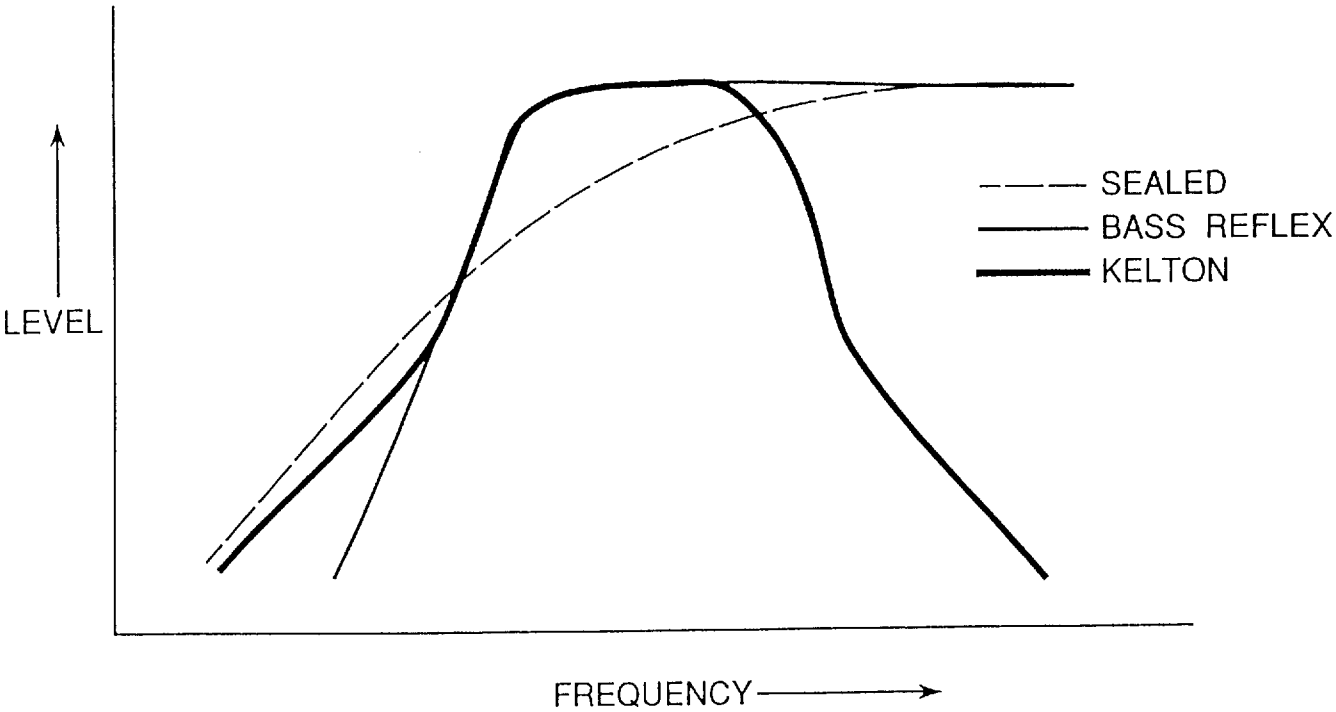
Prior Art Fig.20
FIG. 20 is a graph of the bandpass characteristics of sealed, bass reflex, and kelton speakers.

Based on the relationship between the effective vibration area and the effective vibration mass described in the discussion of a bass speaker according to the prior art with reference to the electroacoustic equivalent circuit diagram shown in FIG. 12 and FIG. 13, the effective vibration mass of each component in the present embodiment is proportional to the square of the effective vibration area ratio, the driver units 21*a*, 21*b*, 21*c*, and 21*d* operate at the same frequency response, and the passive radiators 22*a*, 22*b*, 22*c*, and 22*d* operate at the same frequency response. The equivalent internal volume occupied by each of the driver units and passive radiators is also distributed so that the total internal volume is proportional to the square of the effective vibration area ratio.

The operation of the bass speaker thus comprised according to the third embodiment is the same as that of the first and second embodiments. As a result, the first and second driver units 21*a* and 11*b* and the third and fourth driver units 21*c* and 21*d* operate in the same phase and with the same frequency response. In addition, the first and second passive radiators 22*a* and 22*b*, and the third and fourth passive radiators 22*c* and 22*d*, also operate in the same phase and with the same frequency response. The operation and characteristics of the bass speaker of the invention during bass range reproduction are therefore identical to the operation and characteristics of the conventional bass speaker described above. The minimum cutoff frequency f1 in the present embodiment is 43 Hz, the maximum cutoff frequency f2 is 130 Hz, and a flat sound pressure frequency response is obtained across the reproducible frequency band from 43 Hz–130 Hz at −3 dB.

By installing the passive radiators in four side panels of the enclosure, the total effective vibration area is equivalent to a 55 cm diameter. As a result, even more powerful bass sounds can be reproduced.

Because the mutually opposing first and second driver units 21*a*, 21*b* and 21*c*, 21*d*, and the mutually opposing first and second passive radiators 22*a*, 22*b* and 22*c*, 22*d* operate with the same frequency response and at the same acoustical phase, i.e., the mutually opposing diaphragms move in opposite directions, the vibration-reaction force of the first passive radiator 22*b* on the bandpass type enclosure 23 and the vibration-reaction force of the second passive radiator 22*b* on the bandpass type enclosure 23 have the same magnitude but opposite vectors. Furthermore, the vibration-reaction force of the third passive radiator 22*c* on the bandpass type enclosure 23 and the vibration-reaction force of the fourth passive radiator 22*d* on the bandpass type enclosure 23 have the same magnitude but opposite vectors.

This means that the vibration-reaction forces exerted by the first and second passive radiators 22*a* and 22*b* on the bandpass type enclosure 23 are mutually cancelling, and the vibration-reaction forces exerted by the third and fourth passive radiators 22*c* and 22*d* on the bandpass type enclosure 23 are mutually cancelling. The vibration-reaction forces of the corresponding driver units 21*a*, 21*b*, 21*c*, and 21*d* also have the same magnitude but opposite vectors, and therefore are also mutually cancelling.

More specifically, enclosure vibrations are greatly suppressed because all vibration-reaction forces are cancelled. As a result, enclosure vibrations are approximately 25 dB less than enclosure vibrations in a conventional bandpass type enclosure averaged across the output band. There is also no electrical input signal loss and no drop in acoustic conversion efficiency.

In addition to achieving the effects of the preceding embodiments as described above, the bass speaker of the present embodiment is also able to maximize the total effective vibration area achievable in a limited enclosure size by mounting passive radiators to all but the top and bottom surfaces of the enclosure. As a result, an extremely power bass range output can be obtained.

It will also be obvious that the relationships between the mounting surfaces and positions, the numbers of driver units and passive radiators, the usable enclosure types, and other design parameters can also be varied in this embodiment as in the first embodiment above.

It should also be noted that each of the four driver units can have the same effective vibration area and effective vibration mass, and each of the four passive radiators can have the same effective vibration area and effective vibration mass.

The fourth embodiment of a bass speaker according to the present invention is described next below with reference to FIG. 6.

Figure 6:
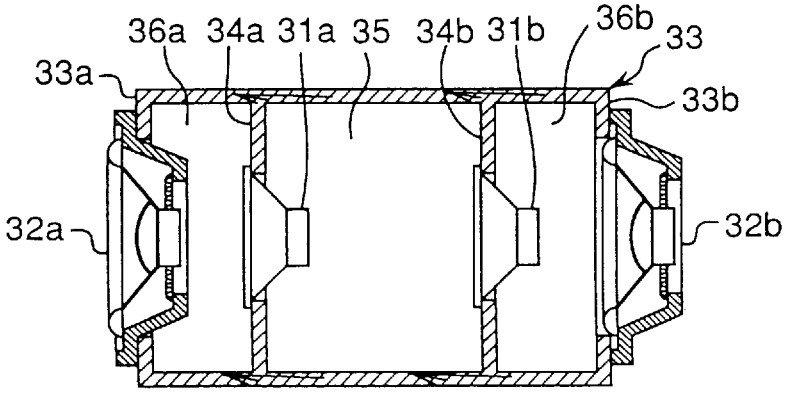
FIG. 6 is a simplified cross section of a bass speaker according to the fourth embodiment of the present invention.

Referring to FIG. 6, the specifications of the driver units 31*a* and 31*b*, the specifications of the passive radiators 32*a* and 32*b*, the specifications of the enclosure 33, the relative positions of the speaker unit opening panels 33*a* and 33*b* and the internal dividers 34*a* and 34*b*, the internal volume of the back cavity 35, and the internal volume of the front cavities 36*a* and 36*b* are all identical to those of the first embodiment. In other words, all components used in the bass speaker of this fourth embodiment are identical to those of the first embodiment.

This fourth embodiment differs from the first in that the orientation of the second driver unit 31*b* and the second passive radiator 32*b* is opposite that of the second driver unit and passive radiator in the first embodiment. Therefore, the two driver units are also electrically connected in opposite phase, and the driver units are thus driven acoustically in the same phase.

The acoustical operation and frequency characteristics of the bass speaker according to the present embodiment thus comprised are identical to those of the first embodiment, and the resulting enclosure vibration attenuation operation and effects are therefore also the same. Further description thereof is thus omitted below.

Due to the opposite-phase connection of the driver units in the present embodiment, the displacement of the diaphragm of the first driver unit 31*a* in one direction is accompanied by the displacement of the diaphragm of the second driver unit 31*b* in the opposite direction, thus compensating for the front-back asymmetry of the vibration system support system, and reducing even-harmonic distortion. This same effect reducing even-harmonic distortion is also achieved with the passive radiators 32*a* and 32*b*. As a result, there was an average 5 dB reduction in second harmonic distortion across the reproducible frequency band in the present embodiment as compared with the first embodiment.

In addition to achieving the effects of the first embodiment as described above, the bass speaker of the present embodiment is able to cancel out the asymmetry of the diaphragm support system and thereby reduce even-harmonic distortion by reversing the orientation of the passive radiator and driver unit on one side of the speaker according to the first embodiment above.

It should be noted that while the orientation of both the driver unit and passive radiator on one side of the speaker system are described as reversed in the present embodiment from the orientation in the first embodiment, the even-harmonic distortion reducing effect of this embodiment will be achieved to some degree even if the orientation of only the driver unit or only the passive radiator is reversed.

Figure 7:
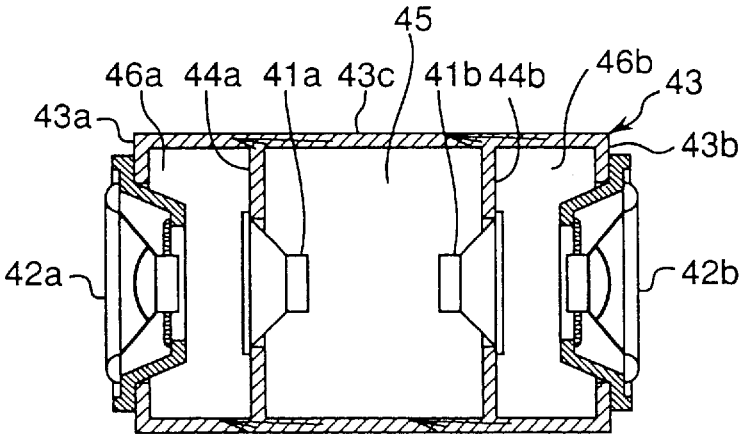
FIG. 7 is a simplified cross section of a bass speaker according to the fifth embodiment of the present invention.

The fifth embodiment of a bass speaker according to the present invention is described next below with reference to FIG. 7, FIG. 8, and FIG. 9.

Referring to FIG. 6, the specifications of the driver units 41*a* and 41*b*, the specifications of the passive radiators 42*a* and 42*b*, the relative positions of the internal dividers 44*a* and 44*b*, the internal volume of the back cavity 45, and the internal volume of the front cavities 46*a* and 46*b* are all identical to those of the first embodiment.

This fifth embodiment differs from the first in that the enclosure 43 is made from a 25 mm thick, high strength particle board. The enclosure panels are further reinforced by using liberal quantities of adhesive at all joints to bond the enclosure panels together. The outside enclosure dimensions are 41 cm×33 cm×80 cm.

The acoustical operation and frequency characteristics of the bass speaker according to the present embodiment thus comprised are identical to those of the first embodiment, and the resulting enclosure vibration attenuation operation and effects are therefore also the same. Further description thereof is thus omitted below.

With the enclosure constructed as described above the first resonant frequency of the center panel 53*c* of the enclosure side panels 43*c* joining the two speaker unit opening panels 43*a* and 43*b* is approximately 300 Hz, and is therefore higher than the 180-Hz maximum cutoff frequency of the reproducible frequency band. The first resonant frequency fr1 of a panel that is fixed on all sides is obtained by equation (1)

$$\mathrm{fr}\mathbf{1}=kt\{E/p(1-u^2)\}^{1/2} \quad (1)$$

where t is the material thickness, E is the Young's modulus of the material, u is Poisson's ratio, p is the density of the material, and k is a constant value specific to the shape of the material. The first resonant frequency was raised sufficiently by increasing the material thickness and increasing the Young's modulus of the material based on equation (1).

Figure 8:
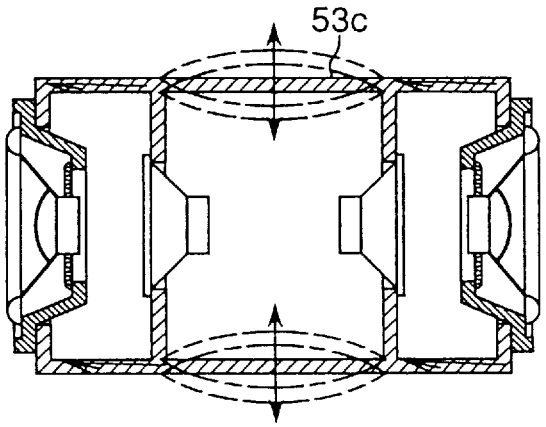
FIG. 8 is used to describe the vibration mode of the first resonant frequency of the enclosure in a bass speaker according to the fifth embodiment of the present invention.
Figure 10:
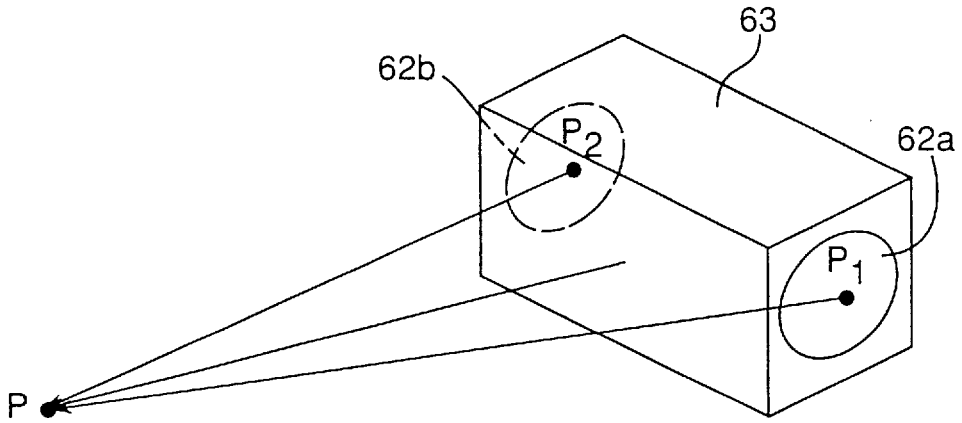
FIG. 10 is a conceptual diagram of the orientation of a bass speaker according to the present invention.

Referring to FIG. 8, the center panels 53*c* of the enclosure side panels 43*c* vibrate to the antinodes of the vibration state during the first resonance mode of the center panel 53*c* when the speaker is driven. As a result, the center panels 53*c* stop functioning as rigid members, and the mutually cancelling effect of the vibration-reaction forces of the driver units and passive radiators on the enclosure is thereby reduced. This effect is also obtained at the second and higher resonant frequencies whereby plural antinodes are produced in the center panels 53*c*.

Referring again to FIG. 7, however, the first resonant frequency of the enclosure side panels 43*c* is set higher than the maximum cutoff frequency of the reproducible frequency band as noted above. The enclosure side panel 43*c* can therefore be treated as a rigid member to the maximum frequency of the reproducible frequency band, thereby retaining the mutually cancelling effect of the vibration-reaction forces of the driver units 41*a* and 41*b* and passive radiators 42*a* and 42*b* on the enclosure 43. This also assures that the enclosure vibration attenuating effect of the invention is sustained to the maximum reproducible frequency of the speaker.

It should be noted that two sizes of enclosure panels are used in the present embodiment, specifically panels measuring 41 cm×80 cm and panels measuring 33 cm×80 cm. The first resonant frequency of the larger 41 cm×80 cm panels is set to approximately 300 Hz, and the first resonant frequency of the smaller 33 cm×80 cm panels is set to approximately 350 Hz. The frequency used as the first resonant frequency is the lower of these frequencies, i.e., 300 Hz in the case of this embodiment.

Figure 9:
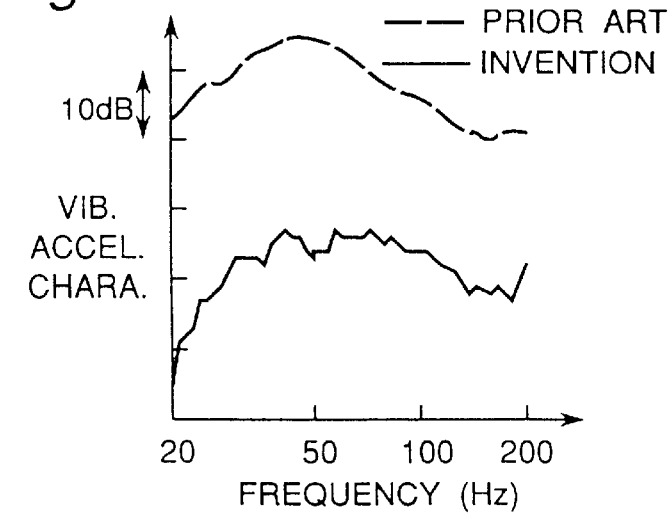
FIG. 9 is a graph of the vibration acceleration characteristic of the enclosure of a bass speaker according to the fifth embodiment of the present invention.

Referring to the graph in FIG. 9 it is known that a vibration attenuation effect of approximately 20 dB is achieved by the present embodiment even near the maximum cutoff frequency, 180 Hz, of the reproducible frequency band. Note, particularly, that the vibration attenuation effect of this fifth embodiment is greater than that of the first embodiment, shown in FIG. 3, at the high end of the reproducible frequency band. Note, also, that the first resonant frequency at the middle of the enclosure side panels in the first embodiment is approximately 150 Hz.

As with the first embodiment above, a bass speaker according to the present embodiment can increase the total effective vibration area by using a large-diameter passive radiator or plural passive radiators, and can thereby reproduce extremely powerful bass range sounds without reducing acoustic conversion efficiency.

Enclosure vibrations are also significantly reduced at all reproducible frequencies because the vibration-reaction forces of the vibration system of each passive radiator and each driver unit acting on the enclosure are mutually cancelled to the maximum cutoff frequency of the reproducible frequency band.

The thickness of the material used for the enclosure was increased to increase the strength of the enclosure as a means of increasing the first resonant frequency at the middle of the enclosure panels. The same effect can be achieved without greatly increasing the panel thickness, however, by providing a reinforcing member in the same enclosure panels.

It should also be noted that the bandpass cutoff frequencies, i.e., the resonant frequencies f1 and f2 of the impedance characteristic, determine the reproducible frequency band of a bass speaker according to the present embodiment based on general filter theory. It is also possible, however, depending upon the design of the bandpass type speaker, for the sound pressure level at resonant frequency f2 to drop greatly from the flat band sound pressure level. In such cases it is appropriate to use the frequency at which the sound pressure level begins to attenuate as the cutoff frequency rather than using resonant frequency f2 of the impedance characteristic.

Note, further, that if there is a localized low-strength section in part of the center panel 53*c* and the resonant frequency of this section is below the maximum cutoff frequency of the reproducible band, this section will produce no noticeable problems insofar as the area of that section is small enough to have no substantial effect on the vibration pattern of the overall center panel 53*c*. It must also be noted that this localized resonant frequency is distinguished from the first resonant frequency referenced in this specification.

The sixth embodiment of a bass speaker according to the present invention is described next below with reference to FIG. 10, FIG. 11, FIG. 12, FIG. 13, FIG. 14, and FIG. 21.

In this sixth embodiment the average distance around the enclosure between the acoustic center of the passive radiator positioned at the front and the acoustic center of the other passive radiator is less than ½ the wavelength of the maximum cutoff frequency of the reproducible frequency band. The objective and principle for this design constraint is described first in detail below before proceeding to a description of the embodiment.

In the bass speaker of the invention sound is emitted from two or more passive radiators. If the enclosure 63 is placed so that the listening position P is equidistant from the acoustic center P1 of the first passive radiator 62*a* and the acoustic center P2 of the second passive radiator 62*b*, there will be no phase difference in the sound emanating from the passive radiators 62*a* and 62*b* and reaching the listening position P.

It is not always possible to place the enclosure in this ideally oriented position in the listening room, however, and a phase difference thus results between the sounds reaching the listening position P from each of the passive radiators. This phase difference can significantly disrupt the sounds heard at the listening position P, and in certain scenarios the sound pressure level at the listening position P may actually be reduced to zero by this phase difference.

The present embodiment specifically addresses this problem and prevents phase-difference induced sound cancellation regardless of where the enclosure is placed.

Figure 11:
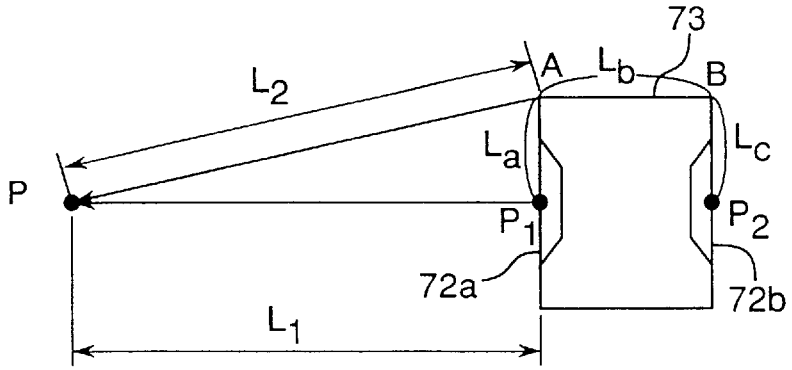
FIG. 11 is used to describe the average distance conditions of the present invention.

The conditions under which such sound cancellation does not occur are considered below with reference to FIG. 11. The enclosure 73 in this embodiment is cylindrically shaped with a round profile when seen from the listening position P. As a result, there is a constant distance relationship between the listening position P and the acoustic centers P1 and P2 of the first and second passive radiators at all points around the center axis of this cylindrical enclosure 73. The distance difference Ld to the listening position P from the acoustic centers P1 and P2 of the first and second passive radiators is obtained by equation (2).

$$Ld=(P2B+BA+L2)-L1 \quad (2)$$

where the relationship $$P2B+BA+AP1+L1 \geqq P2B+BA+L2 \quad (3)$$

is true and the two sides of this equation are equal when L1=0.

From equations (2) and (3) we derive equation 4.

$$Ld \leqq P2B+BA+AP1=Lp \quad (4)$$

From equation (4) we know that the distance difference Ld from the acoustic centers P1 and P2 of the first and second passive radiators to the listening position P is less than the distance LP from the acoustic center P1 of the first passive radiator 72*a* to the acoustic center P2 of the second passive radiator 72*b*.

The relationship between the sound pressure p1 reaching the listening position P from the first passive radiator 72*a* and the sound pressure p2 reaching the listening position P from the second passive radiator 72*b* is obtained from equation 5 and equation 6 where $$p2=p1\times(L1/P2B+BA+L2) \quad (5)$$

$$p2 \leqq p1 \quad (6)$$

and equality is achieved when L1 is ∞ (infinity). More specifically, the sound pressure reaching the listening position P from the first passive radiator 72*a* is less than or equal to the sound pressure reaching the listening position P from the second passive radiator 72*b*.

Sounds emanating from the two passive radiators are cancelled when the sound pressure levels are equal and the phase difference is 180°, i.e., when the distance difference is the half-wave length of the sound. Based on equations (4) and (6), therefore, we know that sound cancellation will not occur at any frequency at which the distance Lp is the half-wave length of the sound or less.

Therefore, if the distance Lp (=La+Lb+Lc) around the enclosure sides between the acoustic center P1 of the first passive radiator 72*a* and the acoustic center P2 of the second passive radiator 72*b* is less than ½ the wavelength of the maximum cutoff frequency of the reproducible frequency band with the cylindrical enclosure 73 of the present embodiment, sound cancellation can be prevented across the reproducible band no matter how the enclosure is oriented.

The "average distance" referenced above is also described below. Most speaker enclosures are some type of cuboid as shown in FIG. 12, and virtually no cylindrical enclosures are available. The distance Lp from the acoustic center P1 of the first passive radiator 82*a* to the acoustic center P2 of the second passive radiator 82*b* around the enclosure 83 differs according to angle θ. With such enclosures the average distance used herein can be obtained by obtaining distance Lp averaged around the complete 360° arc around the acoustic center P1. If the distance Lp at angle θ is expressed as the function of θ, f(θ) where $$Lp=f(\theta) \quad (7)$$

the average distance Lp can be obtained from equation (8).

$$Lp=\{\int_o^{2\pi} f(\theta)d\theta\}/2\pi \quad (8)$$

The value returned by equation (8) is the "average distance" referenced herein. The average distance in this case can be approximated as the distance Lp obtained with a cylindrical enclosure where the area of the circle is the same as the area of the front surface of the cuboid enclosure.

Note that the average distance when there are four passive radiators can be obtained by simply expanding the above concepts. More specifically, the required average distance value can be obtained by calculating the average distance from the passive radiator on the front to each of the other three passive radiators using equation (8), adding these three average distances, and then dividing the sum by three. When the sound pressure generated by each of the passive radiators differs, the final average distance can be obtained by weighting each average distance value by the corresponding sound pressure level and obtaining the weighted mean.

It is therefore possible with a bass speaker according to this embodiment to completely prevent sound cancellation within the frequency band reproduced by the speaker under all installation and listening conditions by designing the enclosure so that the average distance as calculated by equation (8) from the acoustic center of the passive radiator positioned at the front around the enclosure to the acoustic center of each of the other passive radiators is less than ½ the wavelength of the maximum cutoff frequency of the reproducible frequency band.

The sixth embodiment of a bass speaker according to the present invention is described next below with reference to FIG. 13.

The bass speaker of the sixth embodiment comprises as shown in FIG. 13 a first driver unit 91*a* and a second driver unit 91*b* each with a diameter of 14 cm, an effective vibration radius of 56 mm, and an effective vibration mass of 12 g. As a result, both first and second driver units have the same effective vibration area and vibration mass. The minimum resonant frequency of these driver units is 50 Hz, the dc resistance of the voice coil is 10 Ω, and the flux density B1 of the magnetic circuit is 6.0 Wb/m. Both first and second driver units 91*a* and 91*b* are driven same-phase, and are electrically connected same-phase in parallel.

Both the first and second passive radiators 92*a* and 92*b* are flat rectangular radiators with an aperture of 22 cm×16 cm, an effective vibration radius of 73 mm when converted to a circular diaphragm equivalent, i.e., equivalent to a circular passive radiator with an 18 cm diameter, an effective vibration mass of 42 g, and a minimum resonant frequency of 30 Hz. As a result both passive radiators also have the same effective vibration area and vibration mass.

The bandpass type enclosure 93 has a total depth of 27 cm with the external dimensions of the first and second speaker unit opening panels 93*a* and 93*b*, respectively, being 22 cm wide by 36.5 cm high. The enclosure 93 is thus very compact. The enclosure is made from 21 mm thick medium density fiber board (MDF).

The first passive radiator 92*a* and the second passive radiator 92*b* are mounted at opposite positions in the first and second speaker unit opening panels 93*a* and 93*b*, respectively, facing toward the outside of the enclosure.

The first and second driver units 91*a* and 91*b* are installed at mutually opposing positions in the first and second internal dividers 94*a* and 94*b* with the driver units facing away from each other toward the outside of the enclosure. Note that the driver unit positions are offset so that the field elements of the opposing driver units do not collide.

The back cavity 95 formed between the first and second internal dividers 94*a* and 94*b* has an internal volume of approximately 6.4 liters. Both driver units 91*a* and 91*b* use this back cavity so that each driver unit has an equivalent back cavity volume of approximately 3.2 liters. The first and second front cavities 96*a* and 96*b* each have an internal volume of approximately 2.1 liters. The total internal volume of the enclosure 93 is thus only 10.6 liters.

The acoustical operation and the enclosure vibration attenuation effect of the bass speaker thus comprised according to the sixth embodiment are the same as in the first embodiment. As a result, a substantially flat sound pressure frequency response is obtained across the reproducible frequency band from 68 Hz–185 Hz at −3 dB where the minimum cutoff frequency f1 is 68 Hz and the maximum cutoff frequency f2 is 185 Hz.

The total effective vibration area of the passive radiators is equivalent to a 25 cm diameter radiator despite the extremely compact size of the enclosure. As a result, the bass output of the bass speaker according to this embodiment is significantly more powerful than what can obtained from a conventional bass speaker of equivalent volume.

Enclosure vibrations are also reduced approximately 20 dB across the output band all the way to the 185-Hz maximum cutoff frequency. The first resonant frequency of the center side panels 93*c* connecting the speaker unit opening panels 93*a* and 93*b* is approximately 600 Hz, and is thus higher than the maximum cutoff frequency.

The depth of the enclosure is also greatly reduced by using flat passive radiators 92*a* and 92*b*, and mounting the driver units 91*a* and 91*b* so that the field magnets so not collide. The resulting average distance from the acoustic center of the first passive radiator 92*a* on the front of the enclosure to the acoustic center of the second passive radiator 92*b* around the enclosure is 59 cm, which is less than half the wavelength, i.e., 92 cm, of the 185 Hz maximum cutoff frequency. As a result, it is possible to completely prevent sound cancellation within the frequency band reproduced by the speaker under all installation and listening conditions.

In the bass speaker of the first embodiment described above the maximum cutoff frequency is 180 Hz and the half-wave length is thus 94 cm. However, the average distance from the acoustic center of the first passive radiator around the enclosure to the acoustic center of the second passive radiator is 114 cm, which is longer than the half-wave length. As a result, sound cancellation may occur within the reproducible frequency band depending upon the speaker position and listening conditions.

As in the preceding embodiments, the bass speaker of the present embodiment can reproduce powerful bass sounds with a flat sound pressure frequency characteristic despite the compact enclosure size by using passive radiators with a large effective diameter, and can operate with no drop in speaker [acoustic conversion] efficiency.

Enclosure vibrations are also significantly reduced across the reproducible frequency band of the speaker because the vibration-reaction forces of the vibration systems of the passive radiators and driver units acting on the enclosure cancel each other out. From FIG. 21 we know that the bass speaker of the invention reduces enclosure vibrations approximately 25 dB across the entire output band when compared with a conventional bass speaker. Extremely high fidelity bass reproduction is also achieved regardless of the speaker position or listening conditions because there is no sound cancellation within the reproducible frequency band of the speaker.

It should also be noted that the bandpass cutoff frequencies, i.e., the resonant frequencies f1 and f2 of the impedance characteristic, determine the reproducible frequency band of a bass speaker according to the present embodiment based on general filter theory. As in the fifth embodiment, however, it is appropriate to use the frequency at which the sound pressure level begins to attenuate as the cutoff frequency rather than using resonant frequency f2 of the impedance characteristic depending upon the sound pressure—frequency characteristics.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bass speaker comprising a first driver unit, a second driver unit, a first passive radiator and a second passive radiator, said first driver unit, said second driver unit, said first passive radiator and said second passive radiator being mounted in a bandpass type enclosure, said first passive radiator and said second passive radiator being mounted on outside surfaces of said enclosure, such that an axis of said first passive radiator and an axis said second passive radiator are substantially parallel or coaxial to each other;

a first support member disposed inside said enclosure;

a second support member disposed inside said enclosure, said first driver unit and said second driver unit being mounted on said first support member and said second support member, respectively, proximate an axis of the corresponding first passive radiator and second passive radiator, with an axis of said first driver unit and an axis of said second driver unit being substantially coaxial to said first passive radiator and said second passive radiator, wherein a drive phase of said first driver unit and said first passive radiator, and a drive phase of said second driver unit and said second passive radiator are the same, said first driver unit and said second driver unit having a same effective vibration area and a same effective vibration mass, said first passive radiator and said second passive radiator having a same effective vibration area and a same effective vibration mass, a first resonant frequency in a middle of an enclosure panel connecting outside enclosure panels in which said first passive radiator and said second passive radiator are mounted being higher than a maximum cutoff frequency of a reproducible frequency band, an average distance around said enclosure from an acoustic center of said first passive radiator to an acoustic center of said second passive radiator being less than half a wavelength of said maximum cutoff frequency of said reproducible frequency band, a vibration-reaction force of said first passive radiator canceling a vibration-reaction force of said second passive radiator, while a vibration-reaction force of said first driver unit cancels a vibration-reaction force of said second driver unit, so that an enclosure vibration of said bass speaker is minimized, said first passive radiator and said second passive radiator vibrating as a result of said first driver unit and said second driver unit emitting sound, said first passive radiator and said second passive radiator operating to reduce a lower frequency range of said bass speaker while minimizing an enclosure vibration.

2. The base speaker of claim 1 wherein said first passive radiator and said second passive radiator are mounted facing outward from said enclosure, and said first driver unit and said second driver unit are mounted back to back.

3. A bass speaker comprising a first driver unit, a second driver unit, a first passive radiator and a second passive radiator, said first driver unit, said second driver unit, said first passive radiator and said second passive radiator being mounted in a bandpass type enclosure, wherein a drive phase of said first driver unit and said first passive radiator, and a drive phase of said second driver unit and said second passive radiator are the same, said first driver unit and said second driver unit having a same effective vibration area and a same effective vibration mass, said first passive radiator and said second passive radiator having a same effective vibration area and a same effective vibration mass, said first passive radiator being mounted facing outward from said enclosure, said second passive radiator being mounted facing an inside of said enclosure, said first driver unit being mounted facing said first passive radiator, and said second driver unit being mounted facing away from said second passive radiator, said first passive radiator and said second passive radiator vibrating as a result of said first driver unit and said second driver unit emitting sound, said first passive radiator and said second passive radiator operating to reduce a lower frequency range of said bass speaker while minimizing an enclosure vibration.

4. A bass speaker comprising:

a first driver unit;

a second driver unit;

a first passive radiator;

a second passive radiator;

a third passive radiator;

a fourth passive radiator, said first driver unit, said second driver unit, said first passive radiator, said second passive radiator, said third passive radiator and said fourth passive radiator being mounted in a bandpass type enclosure;

a drive phase of said first driver unit and said first passive radiator, and a drive phase of said second driver unit and said second passive radiator are the same, said first driver unit and said second driver unit having a same effective vibration area and a same effective vibration mass, said first passive radiator and said second passive radiator having a same effective vibration area and a same effective vibration mass, said third passive radiator and said fourth passive radiator being mounted on outside surfaces of said enclosure, such that the axes of said third passive radiator and said fourth passive radiator are one of substantially parallel to each other and coaxial to each other;

first and second support members disposed inside said enclosure, said third driver unit and said fourth driver unit being mounted on said first and second support members on or near an axis of said third passive radiator and said fourth passive radiator, with said axes of said third driver unit and said fourth driver unit being at least substantially parallel to said axes of said third passive radiator and said fourth passive radiator.

5. A bass speaker, comprising:

an enclosure;

a first passive radiator and a second passive radiator mounted on outside surfaces of said enclosure, such that the axes of said first passive radiator and said second passive radiator are substantially parallel or coaxial to each other;

a first support member and a second support member disposed inside said enclosure; and a first driver unit and a second driver unit mounted on said first support member and said second support member with the axes of said first driver unit and said second driver unit being substantially perpendicular to the axes of said first passive radiator and said second passive radiator, such that a vibration-reaction force of said first passive radiator cancels a vibration-reaction force of said second passive radiator, while a vibration-reaction force of said first driver unit cancels a vibration-reaction force of said second driver unit, so that an enclosure vibration of said bass speaker is minimized.

* * * * *